US006524139B1

(12) United States Patent
Chang

(10) Patent No.: US 6,524,139 B1
(45) Date of Patent: Feb. 25, 2003

(54) ELECTRICAL CONNECTOR

(75) Inventor: Chia-Chi Chang, Hsin-Tien (TW)

(73) Assignee: Perfect Three Mfg. Corp., Hsin-Tien (TW)

( * ) Notice: Subject to any disclaimer, the term of this patent is extended or adjusted under 35 U.S.C. 154(b) by 0 days.

(21) Appl. No.: 10/054,872

(22) Filed: Jan. 25, 2002

(30) Foreign Application Priority Data

Sep. 13, 2001 (TW) ..... 090215803

(51) Int. Cl.[7] ..... H01R 33/20
(52) U.S. Cl. ..... 439/676
(58) Field of Search ..... 439/676, 76.1, 439/404, 405, 941, 418, 417, 344

(56) References Cited

U.S. PATENT DOCUMENTS 5,752,858 A * 5/1998 Gow et al. ..... 439/676
5,924,896 A * 7/1999 Arnett et al. ..... 439/76.1
5,975,919 A * 11/1999 Arnett et al. ..... 439/676
6,059,578 A * 5/2000 Arnett ..... 439/676
6,116,964 A * 9/2000 Goodrich et al. ..... 439/941
6,176,742 B1 * 1/2001 Arnett et al. ..... 439/676
6,228,643 B1 * 1/2002 Miller et al. ..... 439/676
6,350,158 B1 * 2/2002 Arnett et al. ..... 439/676

* cited by examiner

*Primary Examiner*—Gary Paumen
(74) *Attorney, Agent, or Firm*—Foley & Lardner

(57) ABSTRACT

An electrical connector is adapted to connect two signal transmission cables, and includes a terminal seat with a plurality of insert slots for snugly gripping transmission wires of one transmission cable. The terminal seat has two lateral portions and a transverse portion extending therebetween such that the distances of the adjacent insert slots can be increased so as to increase the distance between the transmission wires respectively mounted in the insert slot, thereby reducing the electromagnetic coupling effect therebetween.

7 Claims, 6 Drawing Sheets

ELECTRICAL CONNECTOR

CROSS-REFERENCE TO RELATED APPLICATION

This application claims priority of Taiwan patent Application No. 090215803, filed on Sep. 13, 2001.

BACKGROUND OF THE INVENTION

1. Field of the Invention

This invention relates to an electrical connector, more particularly to an electrical connector adapted to connect two signal transmission cables each with a plurality of transmission wires.

2. Description of the Related Art

Referring to FIG. 1, a conventional signal transmission cable 1 is shown to include four twisted-pairs of transmission lines 13. Each twisted-pair includes two conductive transmission wires 12 with insulated sheaths 11 coated thereon. The signal transmission cable 1 is provided with a wire terminal plug 14 which terminates the transmission lines 13. Referring to FIGS. 2 and 3, when it is desired to electrically connect first and second signal transmission cables 1,3, an electrical connector 4 is provided and includes a base seat 41, a circuit board 43 mounted on the base seat 41, a terminal member 44 mounted on the circuit board 43, a socket member 42 formed on the base seat 41 for insertion of the wire terminal plug 14 such that the transmission wires 12 are electrically connected to the circuit board 43 via the terminal member 44, and a terminal seat 45. The terminal seat 45 has two lateral walls 451 which extend parallel to each other, and each of which have four insert slots 452 that are formed therein and that extend parallel to one another to snugly grip transmission wires 32 of the signal transmission cable 3. In each insert slot 452, a terminal 455 is disposed to electrically contact the respective transmission wire 32, and is electrically connected to the circuit board 43. Thus, the electrical connection between transmission wires 12 and 32 of the first and second signal transmission cables 1 and 3 can be established. Another type of the terminal seat 5 is shown to have an elongate wall 51 with eight parallel-arranged insert slots 53 formed therein for snugly gripping the transmission wires 32 of the second signal transmission cable 3.

For long-distance signal transmission, the conventional electrical connectors described above will result in electromagnetic coupling effect among the transmission wires 32 of the signal transmission cable 3 at the terminal seats 45,5.

SUMMARY OF THE INVENTION

The object of the present invention is to provide an electrical connector which is capable of minimizing electromagnetic coupling effect among transmission wires of a signal transmission cable connected thereon without the need for increasing the dimensions of the connector.

According to this invention, the electrical connector includes a base seat, and a socket member which is mounted on the base seat for insertion of a wire terminal plug of a first signal transmission cable in a longitudinal direction. A circuit board is mounted on the base seat, and has front and rear segments opposite to each other in the longitudinal direction and electrically connected to each other. A plurality of first terminals are mounted on and are electrically connected to the front segment of the circuit board, and are received in the connecting socket to be adapted to respectively and electrically connect with transmission wires of a first signal transmission cable when the wire terminal plug is inserted into the socket member. A terminal seat is mounted on the rear segment of the circuit board, and includes two lateral portions which are spaced apart from each other in a transverse direction relative to the longitudinal direction and which extend forwardly in the longitudinal direction to form a respective front end, and a transverse portion which extends in the transverse direction between the front ends of the lateral portions. Each of the lateral and transverse portions extends from the circuit board upwardly in an upright direction transverse to the longitudinal and transverse directions to terminate at an upper wall surface. The upper wall surface of each of the lateral and transverse portions is formed with a plurality of insert slots which are displaced from one another. Each insert slot extends downwardly to be adapted to snugly grip a respective transmission wire of a second signal transmission cable by press fitting. A plurality of second terminals are respectively mounted in the insert slots, and are electrically connected to the second segment of the circuit board so as to respectively establish electrical connection with the transmission wires of the second signal transmission cable when the transmission wires are press-fitted respectively into the insert slots. By virtue of the transverse portion of the terminal seat, the distance between adjacent insert slots can be increased so as to increase the distance between the adjacent transmission wires of the second signal transmission cable which are snugly inserted into the insert slots, thereby reducing the electromagnetic coupling effect therebetween without the need to increase the dimensions of the electrical connector.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
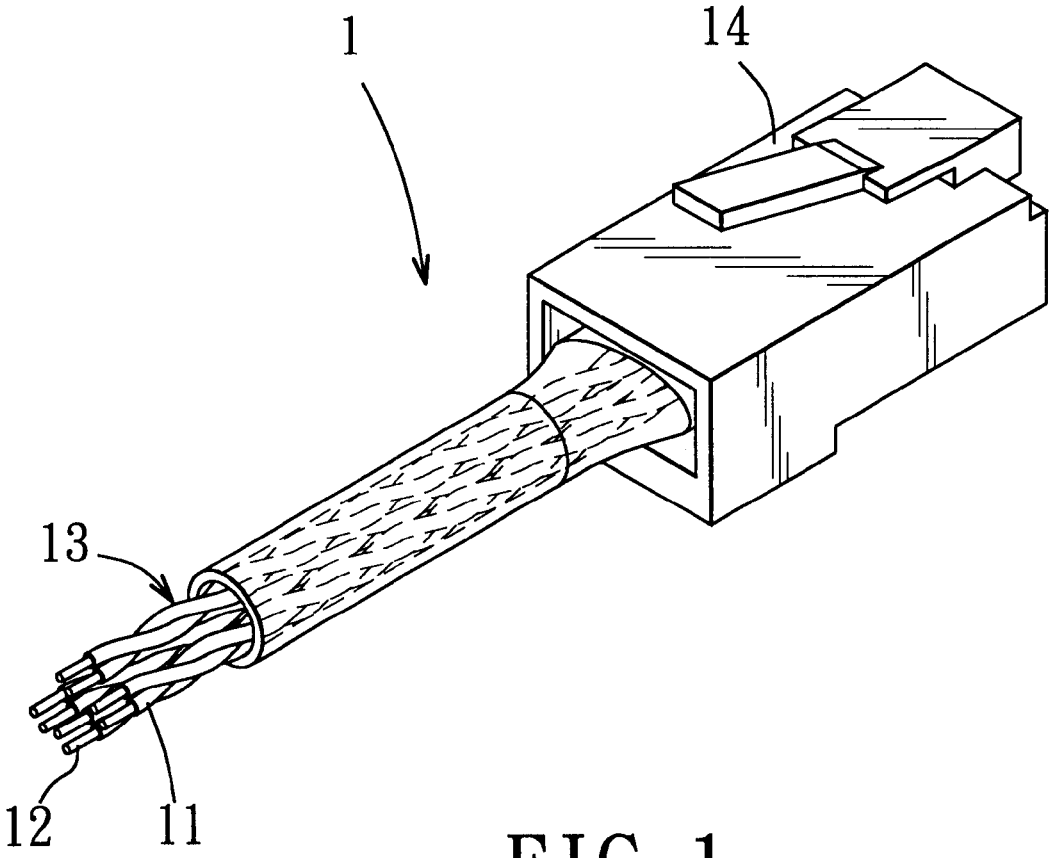
FIG. 1 PRIOR ART
FIG. 1 is a perspective view of a conventional signal transmission cable.
Figure 2:
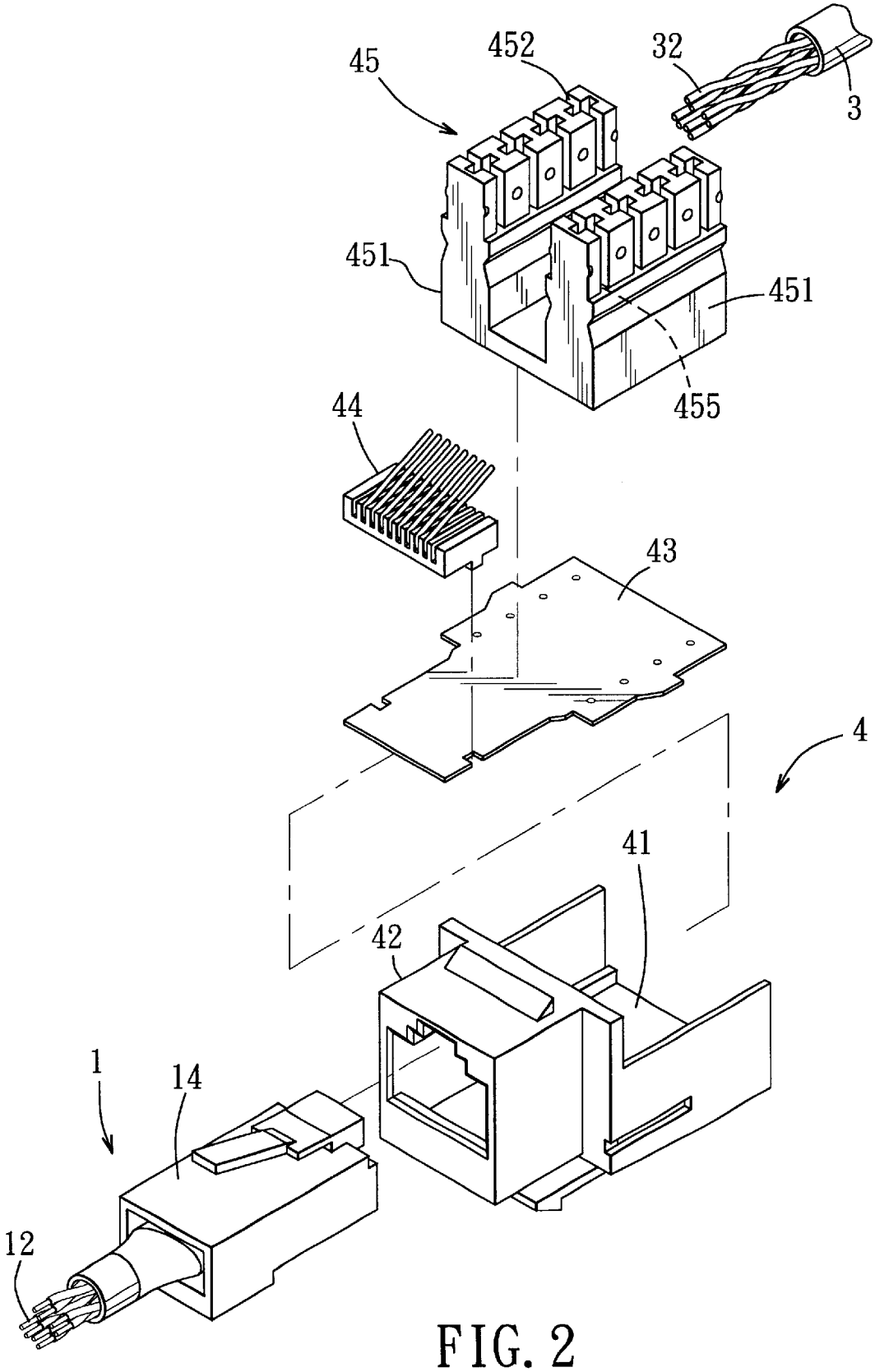
FIG. 2 PRIOR ART
FIG. 2 is an exploded perspective view of a conventional electrical connector to connect two signal transmission cables.
Figure 3:
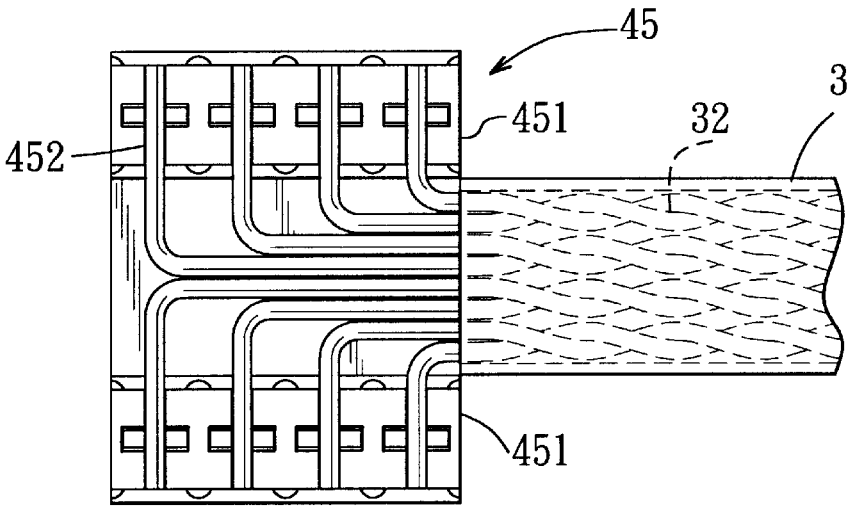
FIG. 3 PRIOR ART
FIG. 3 is a schematic view illustrating how the conventional electrical connector of FIG. 2 is connected to a signal transmission cable.
Figure 4:
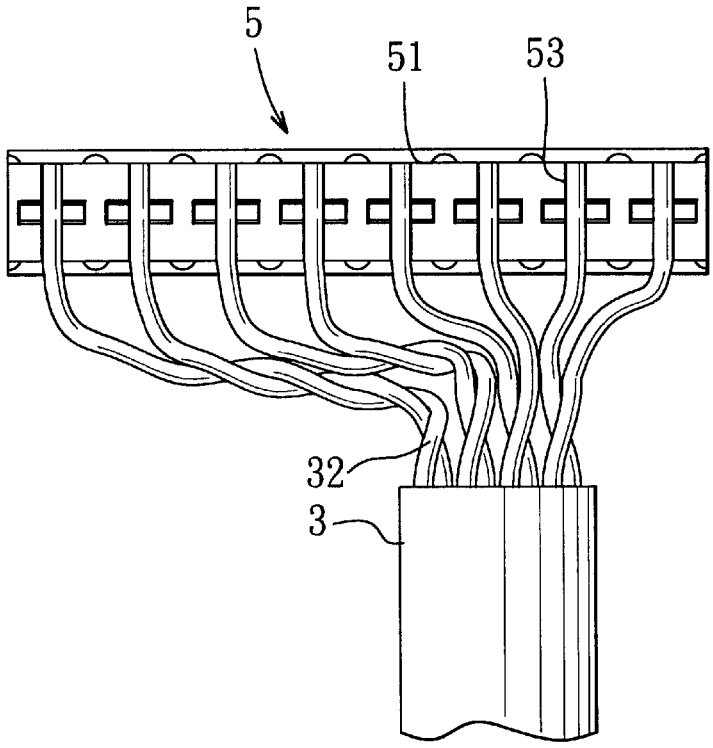
FIG. 4 PRIOR ART
FIG. 4 is a schematic view of another conventional electrical connector connected to a signal transmission cable.

Before the present invention is described in greater detail, it should be noted that same reference numerals have been used to denote like elements throughout the specification.

Figure 5:
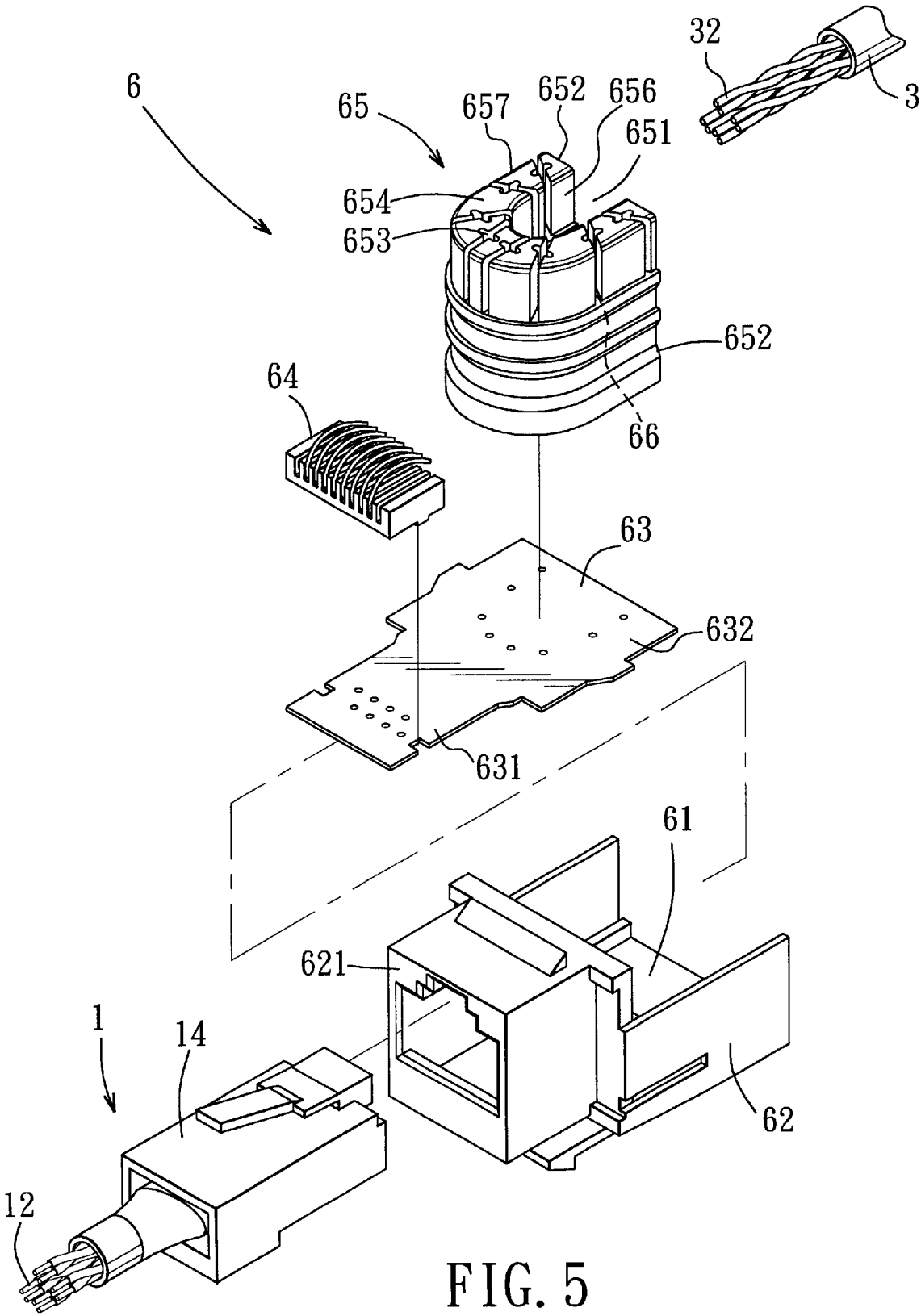
FIG. 5 is an exploded perspective view of a preferred embodiment of an electrical connector according to this invention for connecting two signal transmission cables.
Figure 6:
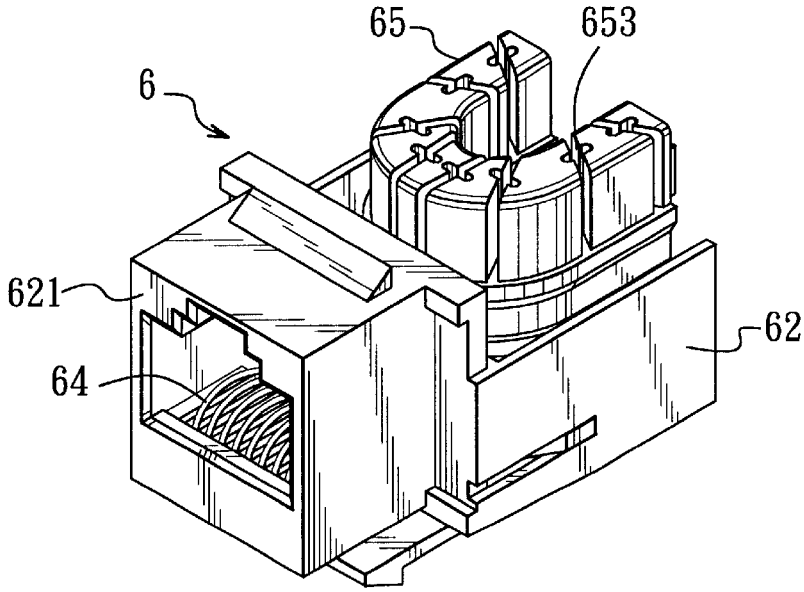
FIG. 6 is a perspective view of the preferred embodiment.

Referring to FIGS. 5 and 6, the preferred embodiment of the electrical connector 6 according to the present invention is shown to comprise a housing 62 with a base seat 61, and a socket member 621 which is formed integrally on the base seat 61 and which is adapted for insertion of a wire terminal plug 14 of a first signal transmission cable 1 in a longitudinal direction. A circuit board 63 is mounted on the base seat 61, and has front and rear segments 631,632 opposite to each other in the longitudinal direction and electrically connected to each other. A plurality of first terminals 64 are disposed on a connecting member which is mounted on the front segment 631 of the circuit board 63 and which is received in the connecting socket 621 so as to make an electrical connection between the first terminals 64 and the front segment 631. Therefore, when the wire terminal plug 14 is inserted into the socket member 621, the first terminals 64 can respectively and electrically connect with the transmission wires 12 of the first signal transmission cable 1.

Figure 7:
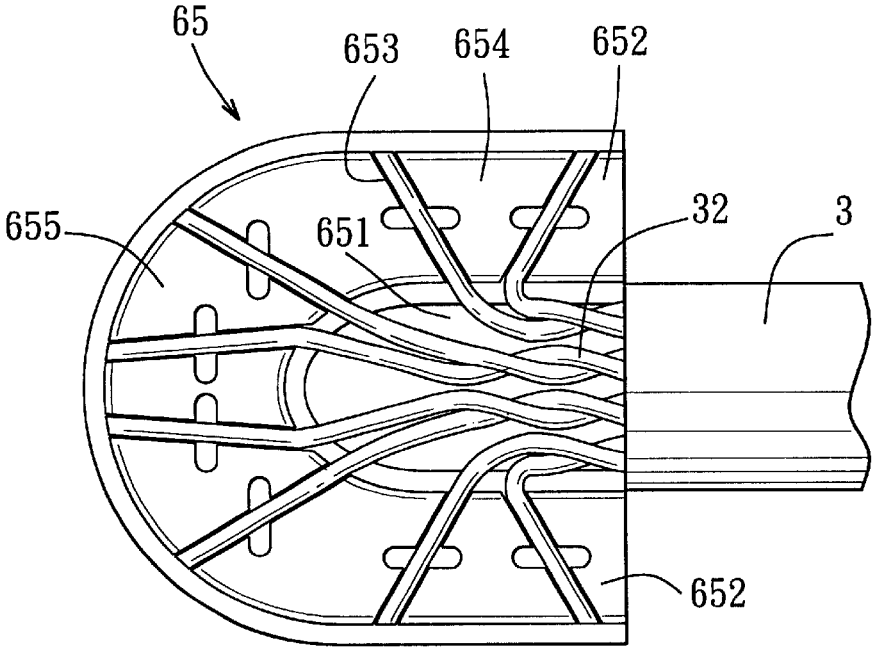
FIG. 7 is a top view showing a terminal seat of the preferred embodiment connected to a signal transmission cable.

With reference to FIG. 7, a terminal seat 65 is received in the housing 62 and is mounted on the rear segment 632 of the circuit board 63. The terminal seat 65 has a cross-section in a horse-shoe shape, and includes two lateral portions 652 which are spaced apart from each other in a transverse direction relative to the longitudinal direction and which extend forwardly in the longitudinal direction to form respectively front ends, and a transverse portion 655 which extends in the transverse direction to interconnect integrally the front ends of the lateral portions 652. Each of the lateral and transverse portions 652,655 extends from the circuit board 63 upwardly in an upright direction transverse to the longitudinal and transverse directions to terminate at an upper wall surface 654. The terminal seat 65 has an inner wall surface 656 which extends from one lateral portion 652 through the transverse portion 655 to the other lateral portion 652 to confine a recessed opening 651 facing rearwards to serve as an access for introducing thereinto transmission wires 32 of a second signal transmission cable 3 in the longitudinal direction, and an outer wall surface 657 which is disposed outboard to the inner wall surface 656.

The upper wall surfaces 654 of the lateral and transverse portions 652,655 are formed with four pairs of insert slots 653 which are displaced from one another. Each insert slot 653 extends downwardly and extends from the inner wall surface 656 through the outer wall surface 657 so as to be adapted to snugly grip a respective one of the transmission wires 32 of the second signal transmission cable 3 by press fitting. A second terminal 66 is mounted in each insert slot 653, and is electrically connected to the second segment 632 of the circuit board 63 so as to establish electrical connection with the respective transmission wire 32 of the second signal transmission cable 3 when the transmission wires 32 are press-fitted respectively into the insert slots 653. In this embodiment, each pair of the insert slots 653 are disposed adjacent to each other and extend to diverge from each other from the inner wall surface 656 to the outer wall surface 657 so as to define an angle of 45 degrees therebetween.

Therefore, the distance between each pair of the insert slots 653 can be increased, as compared with the conventional connector 1 described above, without the need to increase the dimensions of the electrical connector. The transmission wires 32 of the second transmission cable 3, which are snugly inserted into the insert slots 653, extend along the insert slots 653 and have a relatively wider distance therebetween, thereby decreasing the electromagnetic coupling effect.

Figure 8:
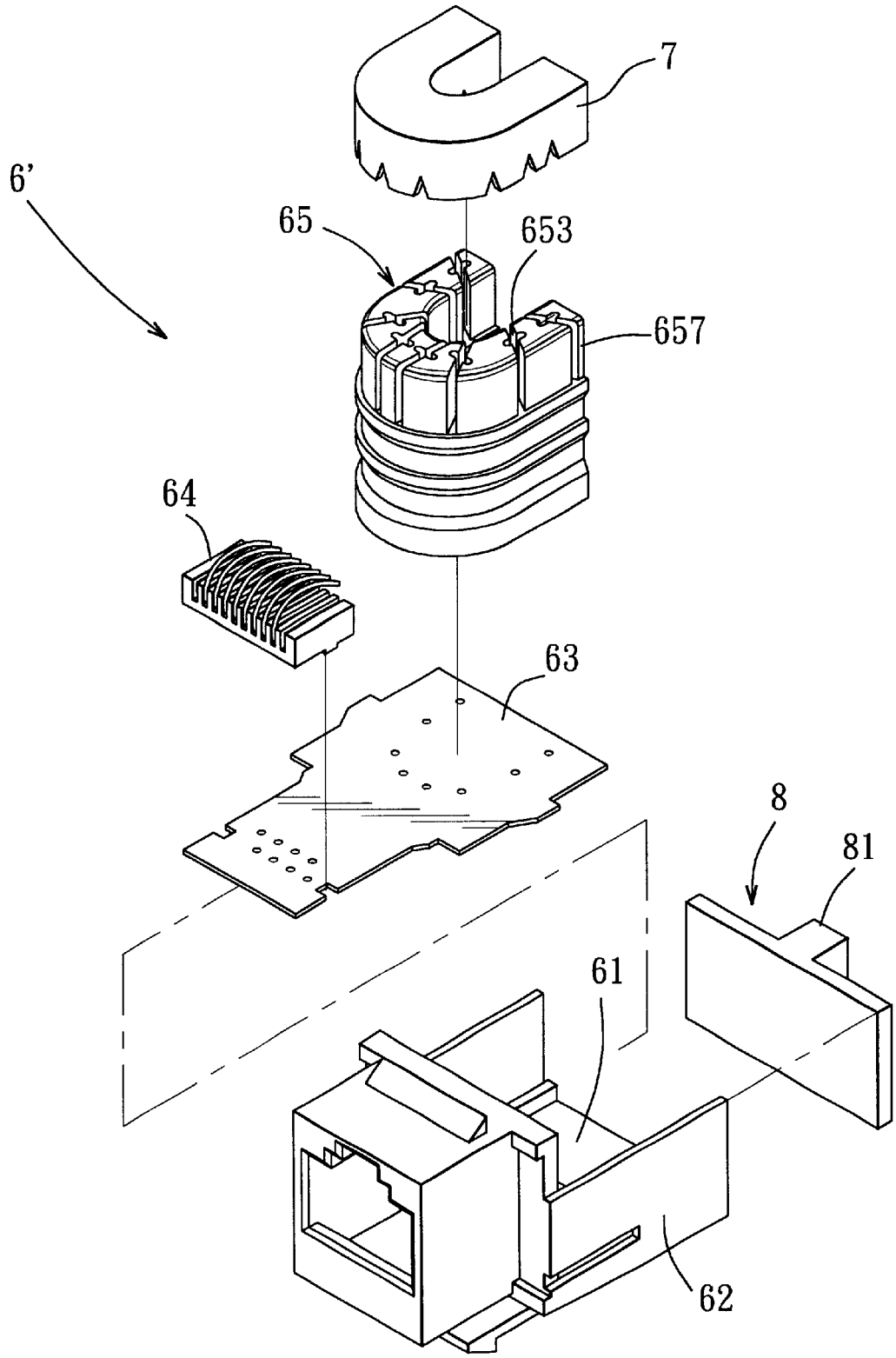
FIG. 8 is an exploded perspective view of another preferred embodiment of this invention.

Referring to FIG. 8, another preferred embodiment of the electrical connector 6' of this invention further includes a shielding member 7 which can be brought downward and in the upright direction to be detachably mounted outboard to the outer wall surface 655 of the terminal seat 65, thereby shielding the insert slots 653. A cover plate 8 is detachably mounted to close the housing 62, and has a retaining member 81 for movably retaining the transmission wires of the second signal transmission cable.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An electrical connector adapted to connect first and second signal transmission cables, each including a plurality of electrically insulated transmission wires, the first transmission cable being provided with a wire terminal plug that terminates the transmission wires thereof, said electrical connector comprising:

a base seat;

a socket member mounted on said base seat and adapted for insertion of the wire terminal plug in a longitudinal direction;

a circuit board mounted on said base seat, and having front and rear segments opposite to each other in the longitudinal direction and electrically connected to each other;

a plurality of first terminals which are mounted on and electrically connected to said front segment, which are received in said connecting socket, and which are adapted to respectively and electrically connect with the transmission wires of the first signal transmission cable when the wire terminal plug is inserted into said socket member;

a terminal seat mounted on said rear segment of said circuit board, and including two lateral portions which are spaced apart from each other in a transverse direction relative to the longitudinal direction and which extend forwardly in the longitudinal direction to form respectively front ends, and a transverse portion which extends in the transverse direction between said front ends of said lateral portions, each of said lateral and transverse portions extending from said circuit board upwardly in an upright direction transverse to the longitudinal and transverse directions to terminate at an upper wall surface, said upper wall surface of each of said lateral and transverse portions being formed with a plurality of insert slots which are displaced from one another, each of said insert slots extending downwardly to be adapted to snugly grip a respective one of the transmission wires of the second signal transmission cable by press fitting; and a plurality of second terminals respectively mounted in said insert slots, and electrically connected to said second segment of said circuit board so as to respectively establish electrical connection with the transmission wires of the second signal transmission cable when the transmission wires are press-fitted respectively into said insert slots.

2. The electrical connector of claim 1, wherein said transverse portion extends to interconnect and is formed integrally with said front ends of said lateral portions.

3. The electrical connector of claim 2, wherein said terminal seat has a recessed opening facing rearwards and adapted to serve as an access for introducing thereinto the transmission wires of the second signal transmission cable in the longitudinal direction, an inner wall surface extending from one of said lateral portions through said transverse portion to the other one of said lateral portions so as to confine said recessed opening, and an outer wall surface disposed outboard to said inner wall surface, each of said insert slots extending from said inner wall surface through said outer wall surface.

4. The electrical connector of claim 3 adapted to connect two sets of twisted-pairs of the electrically insulated transmission wires respectively sheathed in the first and second signal transmission cables, wherein said terminal seat has a plurality of pairs of said insert slots, each pair of said insert slots being disposed adjacent to each other to be adapted to snugly grip a respective pair of the transmission wires of the second signal transmission cable, and extending to diverge from each other from said inner wall surface to said outer wall surface.

5. The electrical connector of claim 4, wherein each pair of said insert slots define an angle of 45 degrees therebetween.

6. The electrical connector of claim 4, wherein said terminal seat has a cross-section in a horseshoe shape.

7. The electrical connector of claim 5, further comprising a shielding member configured such that when said shielding member is brought downward and in the upright direction, said shielding member is disposed outboard to said outer wall surface, thereby shielding said insert slots.

* * * * *